US006701593B2

(12) United States Patent
Lin et al.

(10) Patent No.: US 6,701,593 B2
(45) Date of Patent: Mar. 9, 2004

(54) PROCESS FOR PRODUCING INKJET PRINTHEAD

(75) Inventors: Chen-Hua Lin, Yunlin Hsien (TW); Ching-Yu Chou, Taipei (TW); Ming-Hsun Yang, Taipei (TW); Arnold Chang-Mou Yang, San Jose, CA (US)

(73) Assignee: Nanodynamics, Inc., Hsinchu (TW)

( * ) Notice: Subject to any disclaimer, the term of this patent is extended or adjusted under 35 U.S.C. 154(b) by 0 days.

(21) Appl. No.: 10/035,055

(22) Filed: Dec. 27, 2001

(65) Prior Publication Data

US 2002/0089572 A1 Jul. 11, 2002

(30) Foreign Application Priority Data

Jan. 8, 2001 (TW) ..... 90100340 A
Jan. 8, 2001 (TW) ..... 90100341 A
Jan. 8, 2001 (TW) ..... 90100342 A
Jan. 8, 2001 (TW) ..... 90100343 A

(51) Int. Cl.[7] ..... H04R 17/00; B41J 2/045

(52) U.S. Cl. ..... 29/25.35; 29/890.1; 29/81.08; 347/68; 347/70; 347/71; 347/72

(58) Field of Search ..... 29/25.35, 890.1, 29/81.08; 347/68, 69, 71, 72

(56) References Cited

U.S. PATENT DOCUMENTS 5,266,964 A * 11/1993 Takahashi et al. ..... 347/72
5,453,769 A * 9/1995 Schantz et al. ..... 347/63
5,500,988 A * 3/1996 Moynihan et al. ..... 29/25.35
5,669,125 A * 9/1997 Shida ..... 29/25.35
6,089,701 A * 7/2000 Hashizume et al. ..... 347/70
6,142,611 A * 11/2000 Pan ..... 347/63

* cited by examiner

*Primary Examiner*—Carl J. Arbes
*Assistant Examiner*—Tai Nguyen
(74) *Attorney, Agent, or Firm*—J.C. Patents

(57) ABSTRACT

An ink cartridge having a piezoelectric jet module has an ink storage module having a hollow ink storage region, a piezoelectric jet module having a plurality of ink chambers and a connection circuit, and an ink channel connected to the ink storage module and to the piezoelectric jet module. The piezoelectric inkjet printhead has a bottom film and chamber walls which are obtained by applying a photosensitive polymer on a substrate on which a piezoelectric layer has been formed and carrying out photolithography.

20 Claims, 10 Drawing Sheets

PROCESS FOR PRODUCING INKJET PRINTHEAD

CROSS-REFERENCE TO RELATED APPLICATION

This application claims the priority benefit of Taiwan applications serial nos. 90100340, 90100341, 90100342, 90100343, filed Jan. 8, 2001, the full disclosure of which is incorporated herein by reference.

BACKGROUND OF THE INVENTION

1. Field of the Invention

The present invention relates to a process for producing a piezoelectric inkjet printhead. More specifically, the present invention relates to a process for producing a piezoelectric inkjet printhead having an ink chamber by using exposure/development of photosensitive polymer.

2. Description of the Related Art

Conventional inkjet printing technology mainly includes thermal bubble inkjet printing and piezoelectric inkjet printing. In thermal bubble inkjet printing, a heater is used to evaporate the ink quickly and generate pressurized bubbles to eject the ink through a nozzle. This type of printer has been successfully commercialized by HP and CANON. However, a thermal bubble inkjet printer operates at a high temperature so that the selectivity of the ink is limited to aqueous solvents and its application is therefore limited.

In piezoelectric inkjet printing, an actuator is deformed by applying a voltage to pressurize and eject the liquid ink. Piezoelectric inkjet printing has the following advantages over the thermal bubble inkjet printing. First, no chemical reaction occurs because of a high temperature, so the color of material printed is not adversely affected. Second, high thermal cycles are not required, resulting in superior duration of the inkjet printhead. The piezoelectric ceramics has high response speed, which help increase the printing speed. Third, it is easy to control ink drops in the piezoelectric inkjet printing process. However, the printing speed in the thermal bubble inkjet printing process is limited by thermal conductivity.

FIG. 1A is a side view of a conventional piezoelectric inkjet printhead. The conventional inkjet printhead is obtained by forming an upper electrode layer 11*a*, a piezoelectric layer 12*a*, a lower electrode layer 11*b* and an upper-wall protection 12*b* made of ceramic, chamber walls 13 made of a green sheet and a bottom film 14 made of a green sheet, then laminating these layers as desired, and sintering. An example of the conventional piezoelectric inkjet printhead is commercially available from the EPSON company.

FIG. 1B is a top view showing the conventional piezoelectric inkjet printhead. An ink chamber 17 is an ink storage region of the inkjet printhead for storing the ink from the ink inlet 15. To effect printing by the printhead, an ink material is supplied to the ink chamber 17 to fill the same, and the pressure within the ink chamber 17 is raised by displacement of the piezoelectric layer, so that ink droplets are ejected through the ink outlet 16 which communicates with the ink chamber 17.

In the above process, all the elements are created by a ceramic thick film process and an alignment and laminating process. The inkjet printhead obtained is so compact that it is not easy to align and assemble, causing poor yield and increased production cost and time.

In the prior art process, a sintering process must be performed after the alignment and laminating process. Non-uniform shrinkage of ceramics during sintering results in structural damage and thus low yield of the product.

SUMMARY OF THE INVENTION

It is one object of the present invention to provide a process to form a piezoelectric inkjet printhead that uses alignment of patterned photosensitive polymer layers instead of laminating thick ceramic layers and sintering. The process of the present invention can solve the problems of piezoelectric inkjet printhead assembly and structural damage that may be caused during sintering. Therefore, with the process of the present invention, an increased yield, a more simplified process and lowered cost can be achieved.

In a first aspect of the present invention, a process for producing a piezoelectric inkjet printhead is provided. A substrate having a plurality of metallic lower electrodes thereon is provided. A piezoelectric layer is formed over the substrate and the metallic lower electrodes. Then, metallic upper electrodes are formed on the piezoelectric layer. A photosensitive polymer layer is formed on the piezoelectric layer having the upper electrodes and the lower electrodes to define chamber wall patterns and then to form chamber walls. Finally, a second photosensitive polymer layer is formed on the chamber walls to define a top film having a plurality of ink inlets and ink outlets. A piezoelectric inkjet printhead is thus obtained.

In a second aspect of the present invention, a process for producing a piezoelectric inkjet printhead is provided. A substrate having at least two through holes therein is provided. A first photosensitive polymer layer is formed on the substrate. The first photosensitive polymer layer is defined to form a bottom film having a plurality of ink inlets and a plurality of ink outlets. A second photosensitive polymer layer is formed on the bottom film to form chamber walls that define the ink chamber. Finally, a ceramic layer having upper and lower electrodes thereon is attached on the top of the chamber walls in a manner that a pair of an upper and lower electrode corresponds to an ink chamber. An inkjet printhead is thus obtained. Furthermore, the substrate can be removed after the inkjet printhead is completed. Alternatively, the position of the ink inlet can be changed to be on the ceramic layer.

In the third aspect of the present invention, a process for producing a piezoelectric inkjet printhead is provided. A substrate having a through hole therein is provided. The substrate can be made of silicon, a ceramic material or metal. Then, a first photosensitive polymer layer is formed on the substrate to define a bottom film having a plurality of ink outlets. One or more photosensitive polymer layers are formed in sequence on the bottom film to define a plurality of ink chambers and chamber walls. Finally, a ceramic piezoelectric layer having electrodes thereon is attached on the tops of the walls in a manner that a pair of an upper and lower electrode corresponds to an ink chamber.

In a fourth aspect of the present invention, an ink cartridge having a piezoelectric inkjet printhead is provided. The ink cartridge of the present invention consists of an ink storage module having a hollow storage region, a piezoelectric jet module having a plurality of ink chambers and a connection circuit for the piezoelectric layer, and an ink channel communicating with the ink storage module and the piezoelectric jet module.

BRIEF DESCRIPTION OF THE DRAWINGS

It is to be understood that both the foregoing general description and the following detailed description are exemplary, and are intended to provide further explanation of the invention as claimed.

The accompanying drawings are included to provide a further understanding of the invention, and are incorporated in and constitute a part of this specification. The drawings illustrate embodiments of the invention and, together with the description, serve to explain the principle of the invention. In the drawings.

DESCRIPTION OF THE PREFERRED EMBODIMENT

Figure 1A:
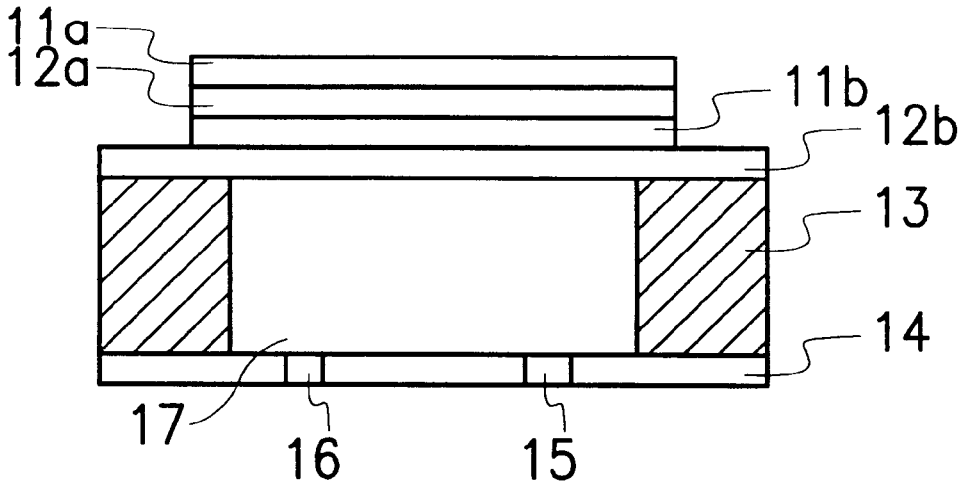
FIG. 1A (PRIOR ART)
FIG. 1A is a schematic, side view showing a process for producing a conventional piezoelectric inkjet printhead.
Figure 1B:
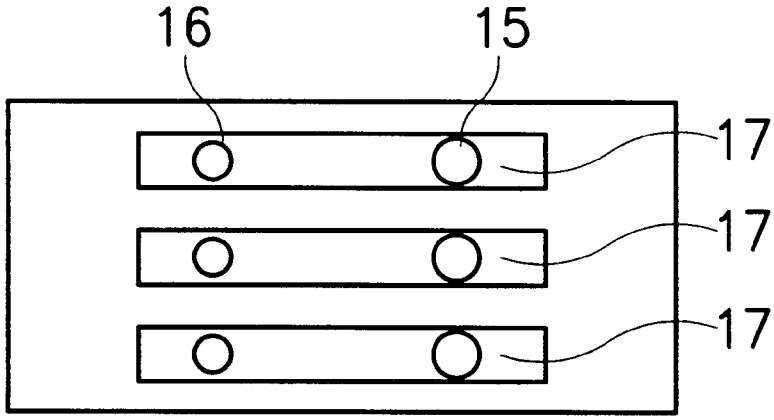
FIG. 1B (PRIOR ART)
FIG. 1B is a schematic, top view showing a process for producing a conventional piezoelectric inkjet printhead.

Reference will now be made in detail to the present preferred embodiments of the invention, examples of which are illustrated in the accompanying drawings. Whenever possible, the same reference numbers are used in the drawings and the description to refer to the same or like parts.

First Embodiment

Figure 2:
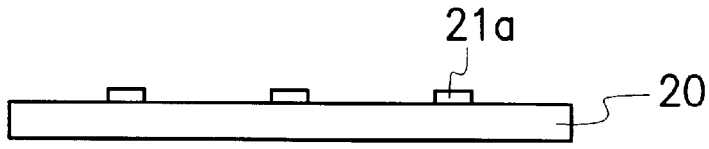
FIGS. 2, 3, 4, 5, and 6 are schematic views showing a process for producing a piezoelectric inkjet printhead according to a first preferred embodiment of the present invention.
Figure 3:
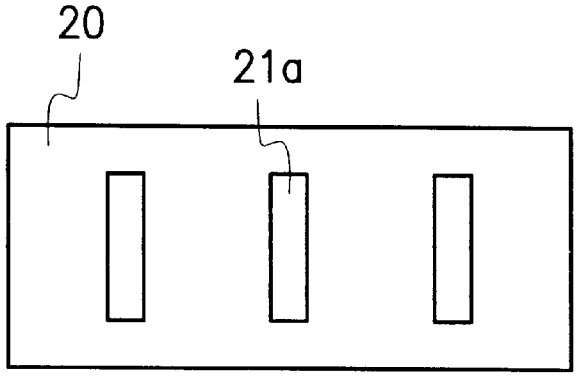

FIGS. 2–6 show a process for producing a piezoelectric inkjet printhead according to one preferred embodiment of the present invention. As shown in FIG. 2, a substrate 20 made of a material such as silicon or ceramic is provided. A plurality of upper electrodes 21*a* is formed on the substrate 20 by screen printing, as shown in FIG. 3. A material used to form the upper electrode 21*a* includes copper (Cu), gold (Au), silver (Ag), platinum (Pt), palladium (Pd), alloys thereof, and the like. The lower electrode 21*a* can be formed in any shape and size as desired.

Alternatively, a physical vapor deposition process such as sputtering and evaporation, or a chemical deposition process such as electrical plating and electroless plating can be used to form a metal layer over the substrate 20. After the metal layer is partially removed, the upper electrodes 21*a* are obtained. The material used to form the metal layer includes copper, gold, silver, platinum, palladium, alloys thereof, and the like. The upper electrode 21*a* can be formed in any shape and size as desired.

Figure 4:
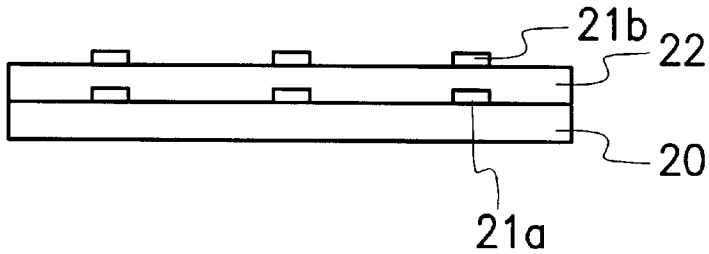

With reference to FIG. 4, a piezoelectric layer 22 is formed on the substrate 20 and the upper electrodes 21*a*. A method of forming the piezoelectric layer 22 can include film spin coating, screen printing or doctor blading, which are well known in the art. The piezoelectric layer 22 can be formed of, for example, a ceramic piezoelectric material such as lead zirconate titanate (PZT), or a piezoelectric polymer such as poly(vinylidene fluoride) (PVDF).

A plurality of lower electrodes 21*b* are formed on the piezoelectric layer 22 by using the same method of forming the upper electrodes 21*a*, as shown in FIG. 3. The lower electrodes 21*b* can be formed of the same material as the upper electrodes 21*a*, and in any shape or size, the same as or different from the upper electrodes 21*a*.

Figure 5:
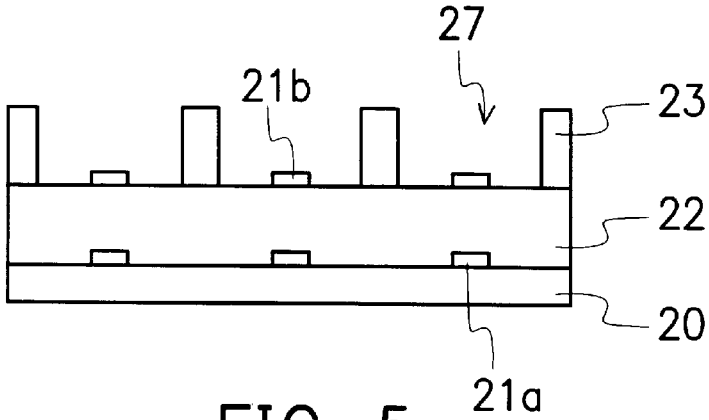

With reference to FIG. 5, a first photosensitive polymer layer is formed on the piezoelectric layer 22 and the lower electrodes 21*b*. The first photosensitive polymer layer has a thickness of about 10–1000 microns. Then, a plurality of chamber walls 23, which define ink chambers 27, are formed in the first photosensitive layer by an photolithography process. Each of the ink chambers 27 is formed in such a manner that one lower electrode 21*b* is located on a bottom of the chamber 27 and a portion of piezoelectric layer 22 and an upper electrode 21*a* is located under the bottom of the chamber 27. Each of the ink chambers is surrounded by portion of the chamber walls 23.

Figure 6A:
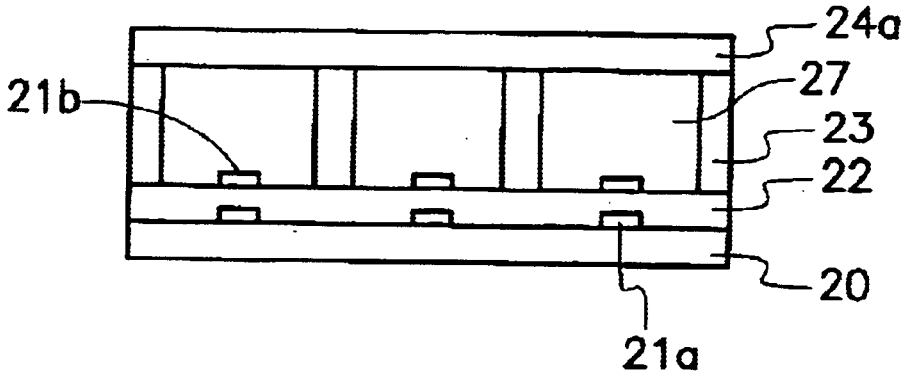
Figure 6B:
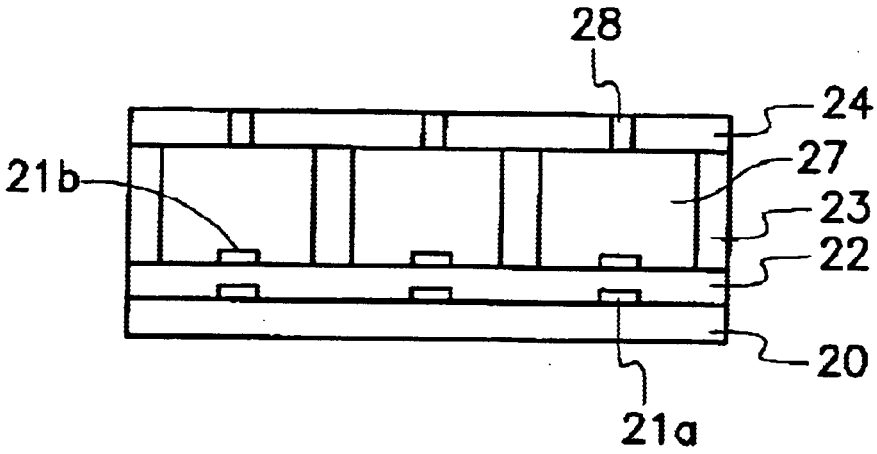

With reference to FIG. 6, a second photosensitive polymer layer is formed on tops of the ink chambers 27 and the chamber walls 23. Then, the second photosensitive polymer layer is subject to photolithography or laser processing to form a top film 24 having a plurality of ink ports 28 which penetrate through the top film 24.

Figure 7:
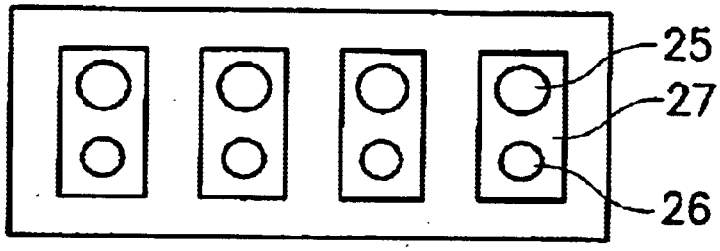
FIG. 7 is a schematic top view showing the process for producing the piezoelectric inkjet printhead according to the first preferred embodiment of the present invention.

FIG. 7 is a schematic top view of the piezoelectric inkjet printhead as shown in FIG. 6. In FIG. 7, the ink port 28 includes an ink inlet 25 and an ink outlet 26. The ink inlet 26 has a diameter of about 50 to about 1000 microns. The ink outlet 26 has a diameter of about 10 microns to about 100 microns.

Examples of photosensitive polymer layer include dry film photoresist, liquid type photoresist, a positive type photoresist, a negative type photoresist, a photosensitive polyimide and photosensitive epoxy.

The dry film photoresist can have a protective layer, a release layer, and a photosensitive polymer layer of about 10–200 microns in thickness. When a dry film photoresist is used to form the top film 24 or the chamber walls 23, the release layer is removed and then the photosensitive polymer layer is attached on a top of the chamber walls 23 or the piezoelectric layer 22. Thereafter, a UV exposure process is carried out and the protective layer is removed. Then,the photosensitive polymer layer is developed to form desired patterns.

When a liquid type photoresist, which is a flowable liquid photosensitive polymer, is used to form the top film 24 or the chamber walls 23, the flowable type liquid is coated as a film on the top of the chamber walls 23 or the piezoelectric layer 22. Thereafter, an UV exposure process is carried out. Then, the liquid type photoresist is developed to form desired patterns.

Second Embodiment

Figure 8:
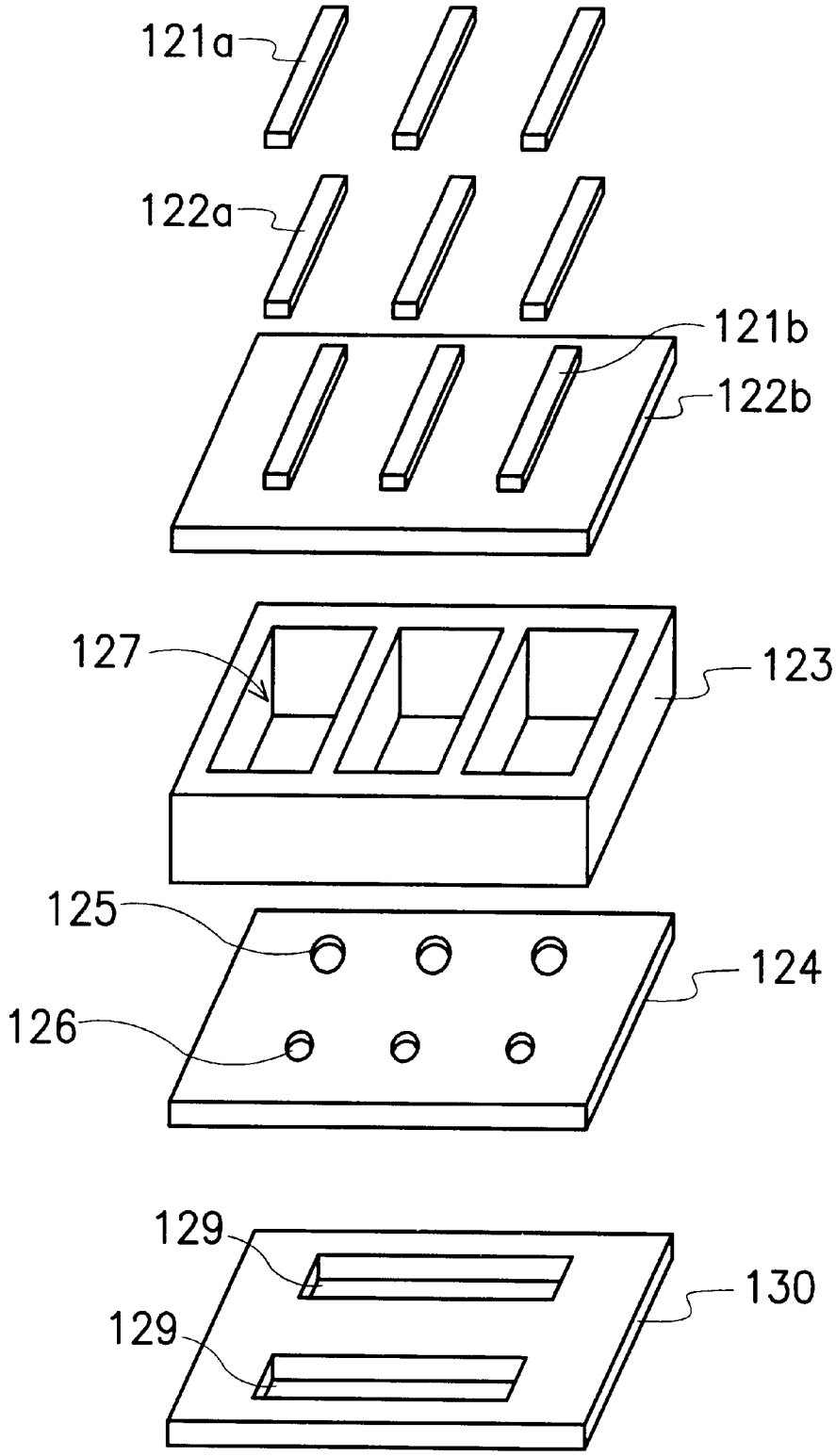
FIG. 8 is a schematic view showing a process for producing a piezoelectric inkjet printhead according to a second preferred embodiment of the present invention.

FIG. 8 is a schematic view of a piezoelectric inkjet printhead according to a second preferred embodiment of the present invention. A substrate 130 such as a silicon substrate or ceramic substrate is provided. A through hole 129 is formed in the substrate 130. Etching, mechanically drilling or particle bombing, for example, can achieve formation of the through hole 129. The through hole 129 can be in the form of a rectangular trench. The dimension of the through hole 129 can be determined as desired.

Then, a first sensitive polymer layer is formed on the substrate 130 and subsequently subjected to an photolithography process to form a bottom film 124 having a plurality of ink inlets 125 and ink outlets 126. The ink inlet 125 has a diameter of about 10–1000 microns. The ink outlet 126 has a diameter of about 10–200 microns.

A second sensitive polymer layer is formed on the bottom film 124. A UV photolithography process is performed to form a plurality of chamber walls 123 defining a plurality of ink chambers 127 in the second sensitive polymer film. Under each of the ink chambers 127 is located a portion of the bottom film 124 having an ink inlet 125 and an ink outlet 126. Alternatively, the ink inlet 125 and the ink outlet 126 can be formed in the substrate 130 by etching, mechanically drilling or particle bombing, for example. As such, the above first photosensitive polymer layer can be omitted and the production process can be thus simplified.

Finally, a ceramic layer 122*b* is formed on tops of the chamber walls. A piezoelectric layer 122*a* is formed on ceramic layer 122*b*. A plurality of upper electrodes 121*a* is provided on a top surface of the piezoelectric layer 122*a*. A plurality of lower electrodes 121*b* corresponding to the upper electrodes 121*a* is provided on a bottom surface of the piezoelectric layer 122*b*. Each of the ink chambers 127 has at least one pair of the upper electrode 121*a* and the lower electrode 121*b*. Examples of the material used to form the upper electrode 121*a* and the lower electrode 121*b* include copper, gold, silver, platinum, palladium, alloys thereof, and the like. The piezoelectric layer 122*a* can be formed of, for example, lead zirconate titanate, or a piezoelectric polymer such as poly(vinylidene fluoride). The ceramic layer 122*b* has a thickness of about ten microns to several millimeters.

Figure 9:
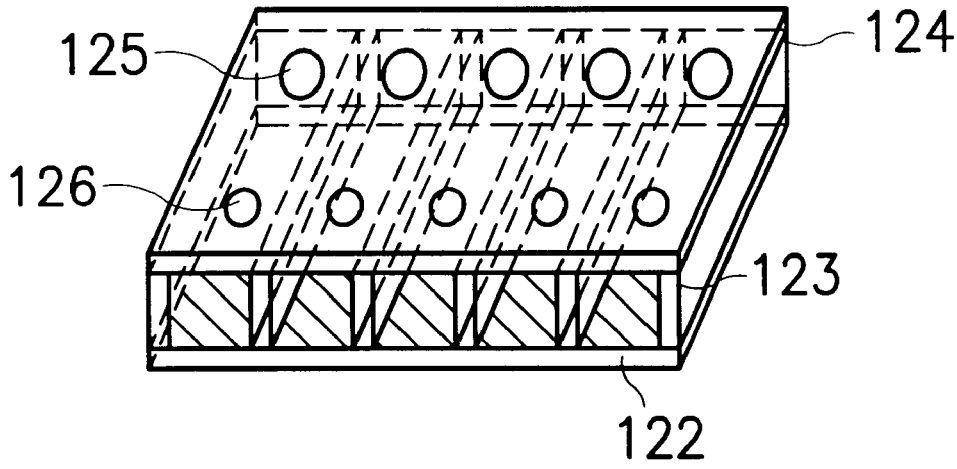
FIG. 9 is a schematic view showing the process for producing the piezoelectric inkjet printhead according to the second preferred embodiment of the present invention.
Figure 10:
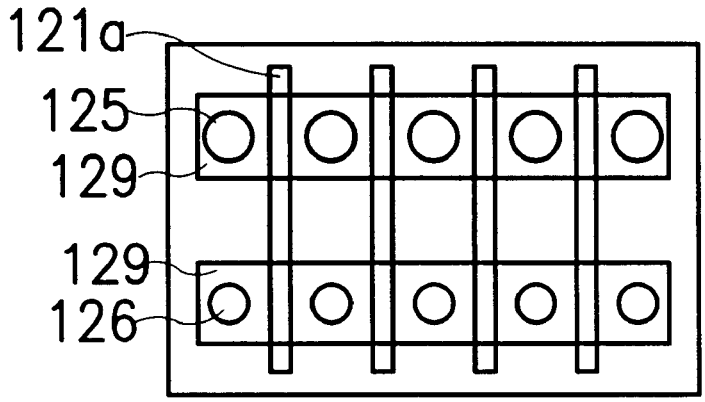
FIG. 10 is a schematic top view showing the process for producing the piezoelectric inkjet printhead according to the second preferred embodiment of the present invention.

FIG. 9 is a schematic perspective view of a piezoelectric inkjet printhead according to the second preferred embodiment of the present invention. FIG. 10 is a schematic top view of FIG. 9. FIG. 9 and FIG. 10 clearly show the configuration of the inkjet printhead produced according to the present invention and the relative position of respective elements of the inkjet printhead.

The photosensitive polymer layer, which can be used in the present invention, includes a dry film photoresist, a liquid type photoresist, a positive photoresist, a negative photoresist, a photosensitive polyimide and a photosensitive epoxy.

When a dry film photoresist is used, the dry film photoresist can be attached directly on the substrate by thermal pressing. When a liquid type photoresist that is a flowable liquid photosensitive polymer is used, the flowable liquid is coated as a film on the substrate or on the bottom film, and then subjected to a UV exposure and development process to form desired patterns.

Third Embodiment

Figure 11:
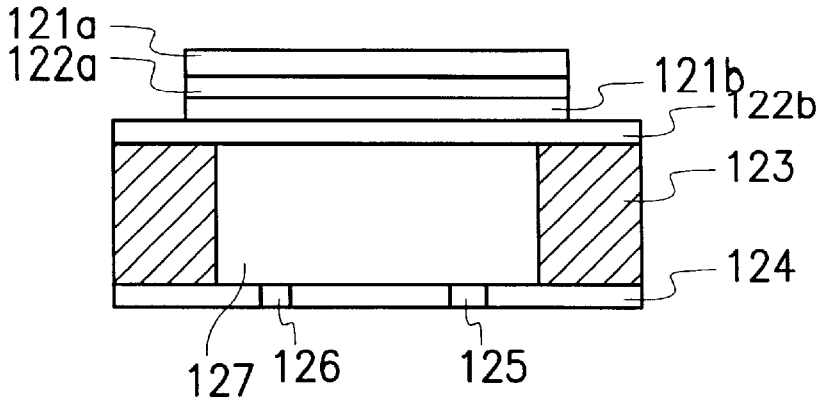
FIG. 11 is a schematic view showing a process for producing a piezoelectric inkjet printhead according to a third preferred embodiment of the present invention.

FIG. 11 is a schematic side view of a piezoelectric inkjet printhead according to a third preferred embodiment of the present invention. The piezoelectric inkjet printhead obtained from the second preferred embodiment is put in an etchant to remove the substrate 130. The piezoelectric inkjet printhead of this example is thus accomplished. In the third preferred embodiment of the present invention, the substrate 130 acts as a carrier for the piezoelectric inkjet printhead during the manufacturing process.

Fourth Embodiment

Figure 12:
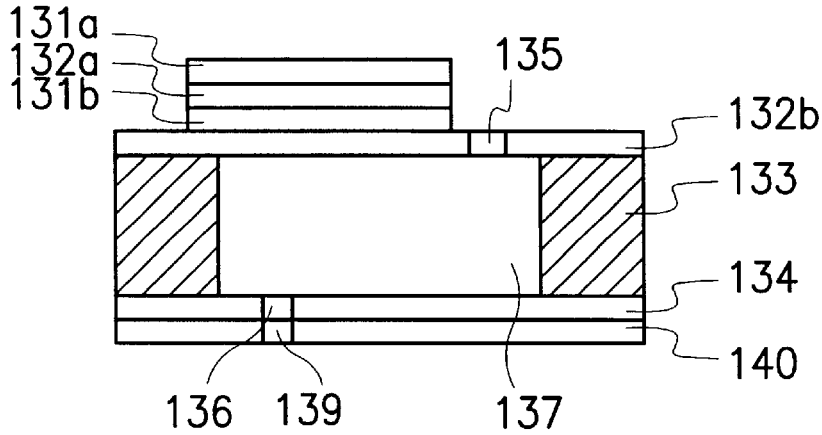
FIG. 12 is a schematic view showing a process for producing a piezoelectric inkjet printhead according to a fourth preferred embodiment of the present invention.

FIG. 12 is a schematic side view of a piezoelectric inkjet printhead according to a fourth preferred embodiment of the present invention. A substrate 140 such as a silicon substrate or ceramic substrate is provided. A through hole 139 is formed in the substrate 140. Etching, mechanically drilling or particle bombing, for example, can achieve the formation of the through hole 139. The through hole 139 can be in the shape of a rectangular trench. The dimension of the through hole 139 can be determined as desired.

Then, a first sensitive polymer layer is formed in the substrate 140 and then subject to an photolithography process to form a bottom film 134 having a plurality of ink outlets 136. The ink outlet 136 has a diameter of about 10–200 microns.

A second sensitive polymer layer is formed on the bottom film 134. A UV exposure and development process is performed to form a plurality of chamber walls 133 defining a plurality of ink chambers 137 in the second sensitive polymer film. A portion of the bottom film 134 having an ink outlet 136 is located under each of the ink chambers 137.

A plurality of ink inlets 135 are formed through a ceramic layer 132*b* by etching, mechanically drilling or particle bombing, such that the ink inlet 135 is provided opposite to and misaligned with the ink outlet 136. The ink inlet 135 has a diameter of about 20–1000 microns. Then, the ceramic layer 132*b* is attached on tops of the chamber walls 133 and the ink chambers 137. A plurality of lower electrodes 131*b*, piezoelectric layers 132*a* and upper electrodes 131*a* is formed in sequence as stacks on the ceramic layer 132*b*, such that each of the stacks corresponds to one of the ink chambers 137 and the ink inlet 135 is exposed. Examples of the material used to form the upper electrode 131*a* and the lower electrode 131*b* include copper, gold, silver, platinum, palladium, alloys thereof, and the like. The piezoelectric layer 132*a* can be formed of, for example, lead zirconate titanate, or a piezoelectric polymer such as poly(vinylidene fluoride). The ceramic layer 132*b* has a thickness of about ten microns to several millimeters.

The photosensitive polymer layer that can be used in the present invention includes a dry film photoresist, a liquid type photoresist, a positive photoresist, and a negative photoresist, a photosensitive polyimide and photosensitive epoxy.

When a dry film photoresist is used, the dry film photoresist can be attached directly on the substrate by thermal press. When a liquid type photoresist, which is a flowable liquid photosensitive polymer, is used, the flowable photoresist liquid is coated as a film on the substrate or on the bottom film and then subjected to a UV exposure and development process to form desirable patterns.

Fifth Embodiment

Figure 13:
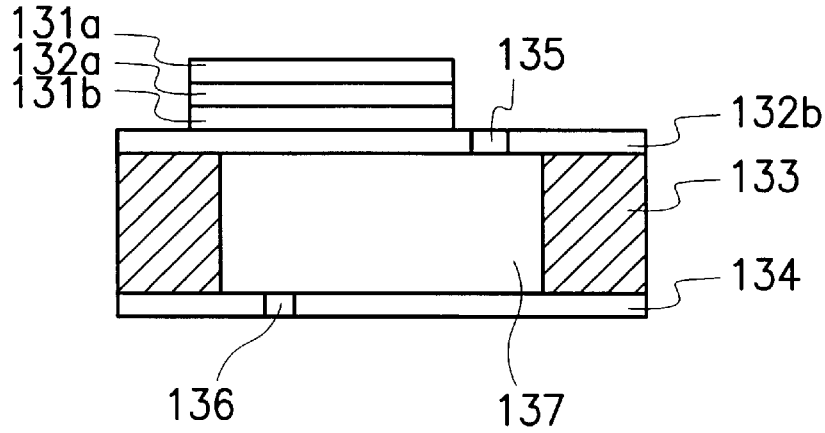
FIG. 13 is a schematic view showing a process for producing a piezoelectric inkjet printhead according to a fifth preferred embodiment of the present invention.

FIG. 13 is a schematic side view of a piezoelectric inkjet printhead according to a fifth preferred embodiment of the present invention. The piezoelectric inkjet printhead obtained from the fourth preferred embodiment is put in an etchant to remove the substrate 140. The piezoelectric inkjet printhead of this example is thus accomplished. In the fifth preferred embodiment of the present invention, the substrate 140 acts as a carrier for the piezoelectric inkjet printhead during the manufacturing process.

Sixth Embodiment

Figure 14:
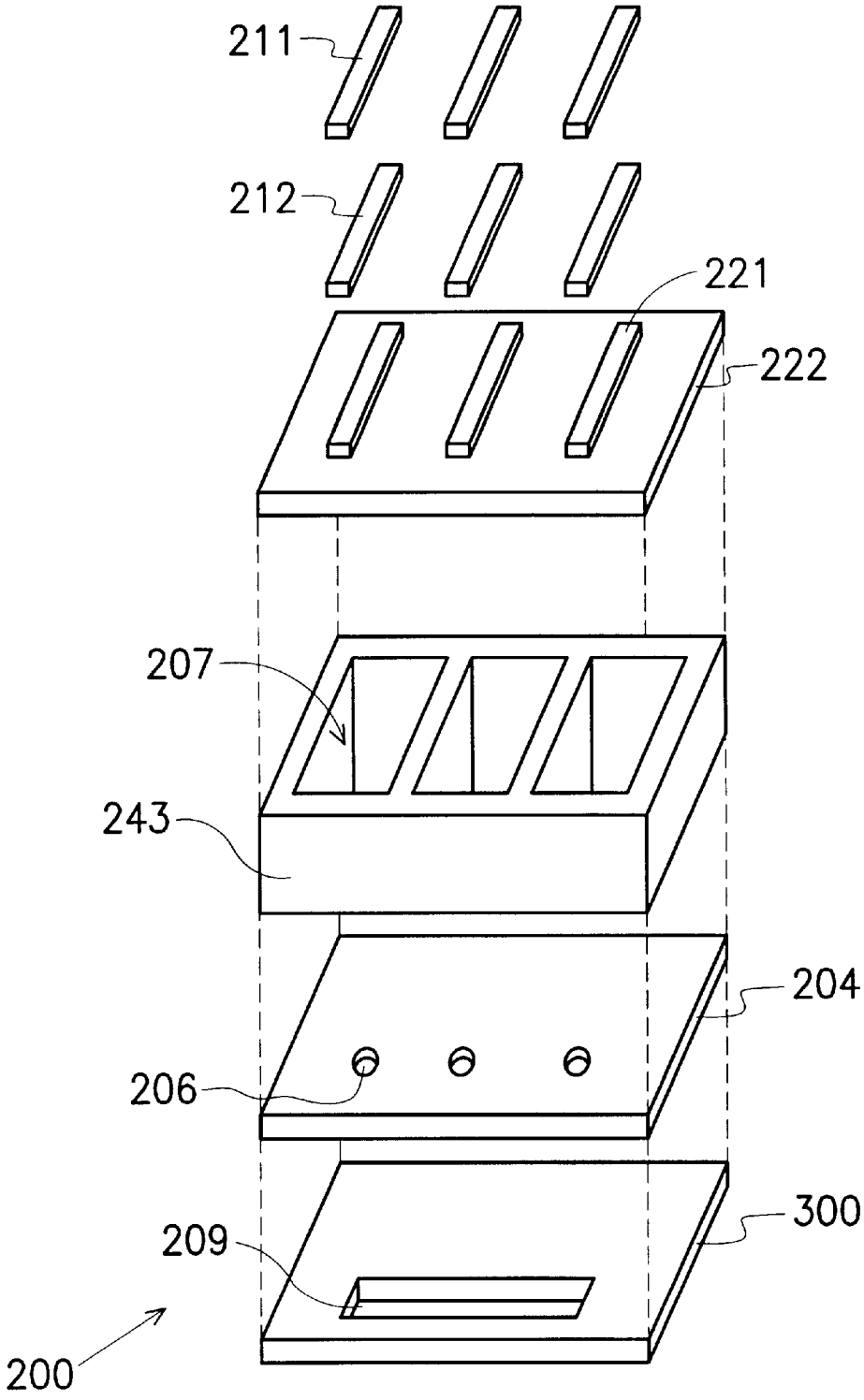
FIG. 14 is schematic view showing a process for producing a piezoelectric inkjet printhead having side inlets according to a sixth preferred embodiment of the present invention.

FIG. 14 is a schematic, exploded view of a piezoelectric inkjet printhead according to a sixth preferred embodiment of the present invention. A substrate 300 such as a silicon substrate or ceramic substrate is provided. A through hole 209 is formed in the substrate 300. The formation of the through hole 209 can be achieved by etching or the like. The through hole 209 can be in the shape of a rectangular trench. The dimension of the through hole 209 can be determined as desired.

Then, a first sensitive polymer layer is formed in the substrate 300 and subsequently subjected to an photolithography process to form a bottom film 204 having a plurality of ink outlets 206. The ink outlet 206 has a diameter of about 10–200 microns.

One or more second sensitive polymer layers are formed on the bottom film 204. An UV exposure and development process is performed to form a plurality of chamber walls 243 defining a plurality of ink chambers 207 in the second sensitive polymer film. A portion of the bottom film 204 having an ink outlet 206 is located under each of the ink chambers 207.

Figure 15:
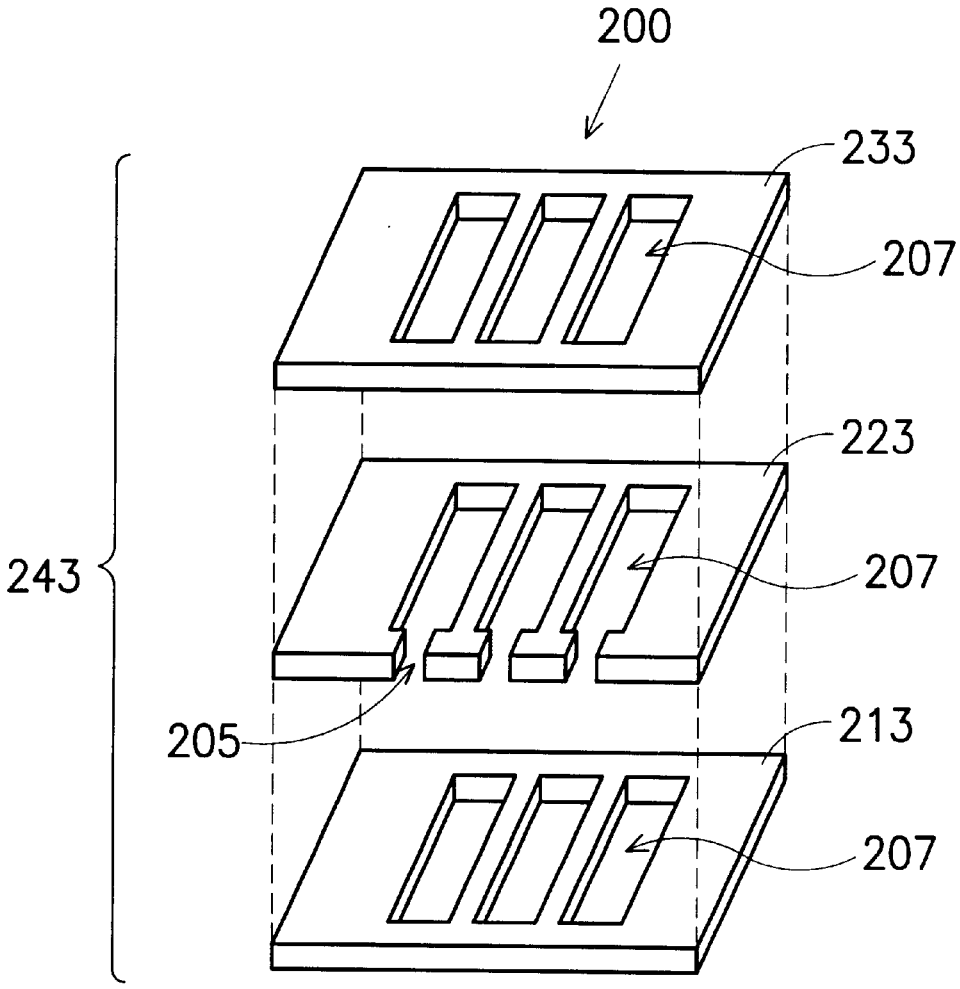
FIG. 15 is a schematic view showing the process for producing the piezoelectric inkjet printhead having chamber walls and ink inlets according to the sixth preferred embodiment of the present invention.

FIG. 15 is a schematic, exploded view of a structure of chamber walls shown in FIG. 14. The chamber walls define the ink chambers 207, at least one of which has at least one ink inlet 205. The ink inlet 205 and the ink outlet 206 can be one or more in number. The ink inlet 205 is located in the second photosensitive polymer layer. The second photosensitive polymer layer consists of three photosensitive polymer layers. The formation of the chamber wall can include three stages.

In the first stage of forming the chamber wall, a third photosensitive polymer layer is formed on the bottom film 204 and subjected to an exposure and development process to define the chamber walls 213.

In the second stage of forming the chamber wall, a fourth photosensitive polymer film is formed on the chamber walls 213 and subjected to an exposure and development process to define chamber walls 223 and ink inlets 205.

In the third stage of forming the chamber wall, a fifth photosensitive polymer film is formed on the chamber walls 223 and subjected to an exposure and development process to define chamber walls 233. The chamber walls 213, 223 and 233 form the chamber wall 243, as shown in FIG. 15.

Finally, with reference to FIG. 14, a ceramic piezoelectric layer 222 having electrode patterns thereon is attached on the top of the chamber walls 243. The piezoelectric layer 222 includes upper electrodes 211, piezoelectric layers 212 and lower electrodes 221 thereon, such that one upper electrode 211 and one lower electrode 221 are located above each of the ink chambers 207, respectively.

Figure 16:
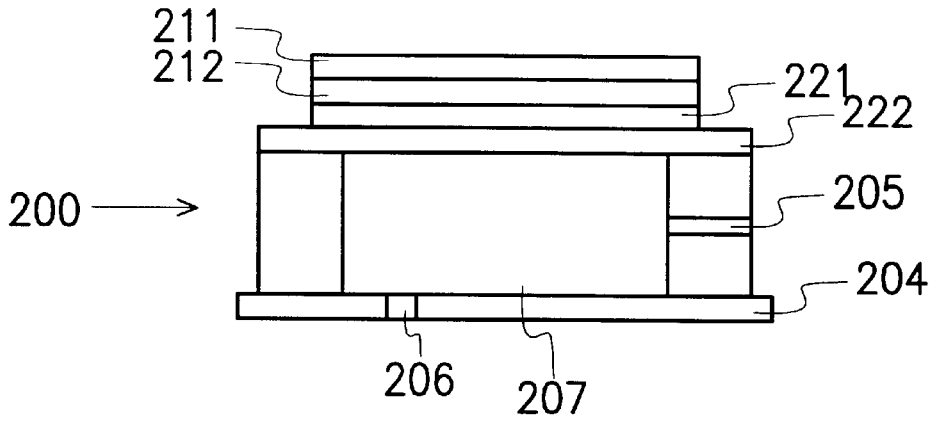
FIG. 16 is a schematic side view of view showing the process for producing the piezoelectric inkjet printhead according to the sixth preferred embodiment of the present invention.
Figure 17:
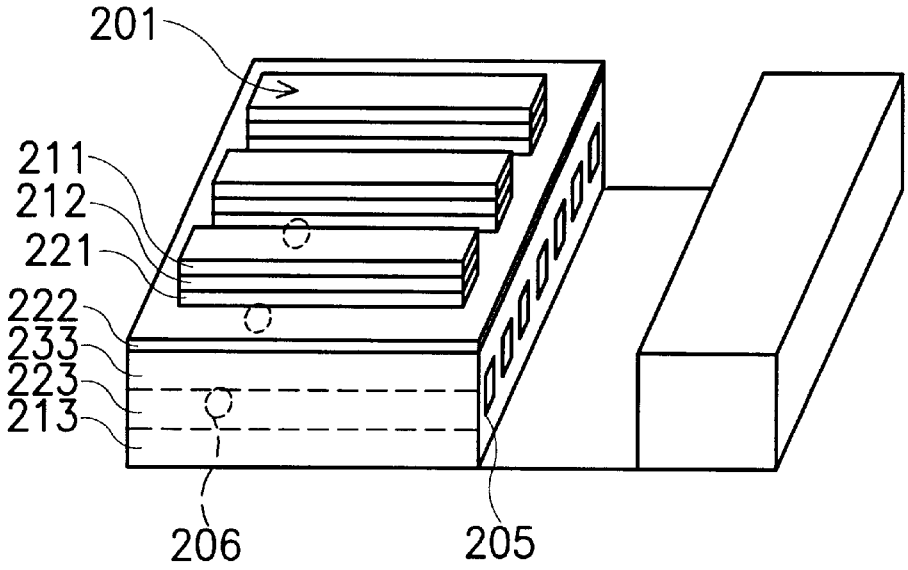
FIG. 17 is a schematic, perspective view showing the process for producing the piezoelectric inkjet printhead according to the sixth preferred embodiment of the present invention.

FIG. 16 is a side view of the piezoelectric inkjet printhead according to the sixth preferred embodiment of the present invention. FIG. 17 is a schematic, perspective view of FIG. 16. FIG. 16 and FIG. 17 clearly show the configuration of the inkjet printhead obtained according to the present invention and the relative position of respective elements of the inkjet printhead.

Alternatively, the piezoelectric layer can be used as a substrate of the present invention. In this case, the ink outlet 206 can be formed on the photosensitive polymer layer on the chamber wall. Thus, the substrate can be omitted and the production process can be simplified.

The photosensitive polymer layer that can be used in the present invention includes a dry film photoresist, a liquid type photoresist, a positive photoresist, and a negative photoresist, a photosensitive polyimide and a photosensitive epoxy. The photosensitive polymer layer before exposure has a thickness of about 10–500 microns.

When a dry film photoresist is used, the dry film photoresist can be attached directly on the substrate by thermal press. When a liquid type photoresist, which is a liquid photosensitive polymer, is used, the flowable liquid is coated as a film on the substrate or on the bottom film and then subjected to a UV exposure and development process to form desirable patterns.

Seventh Embodiment

Figure 18:
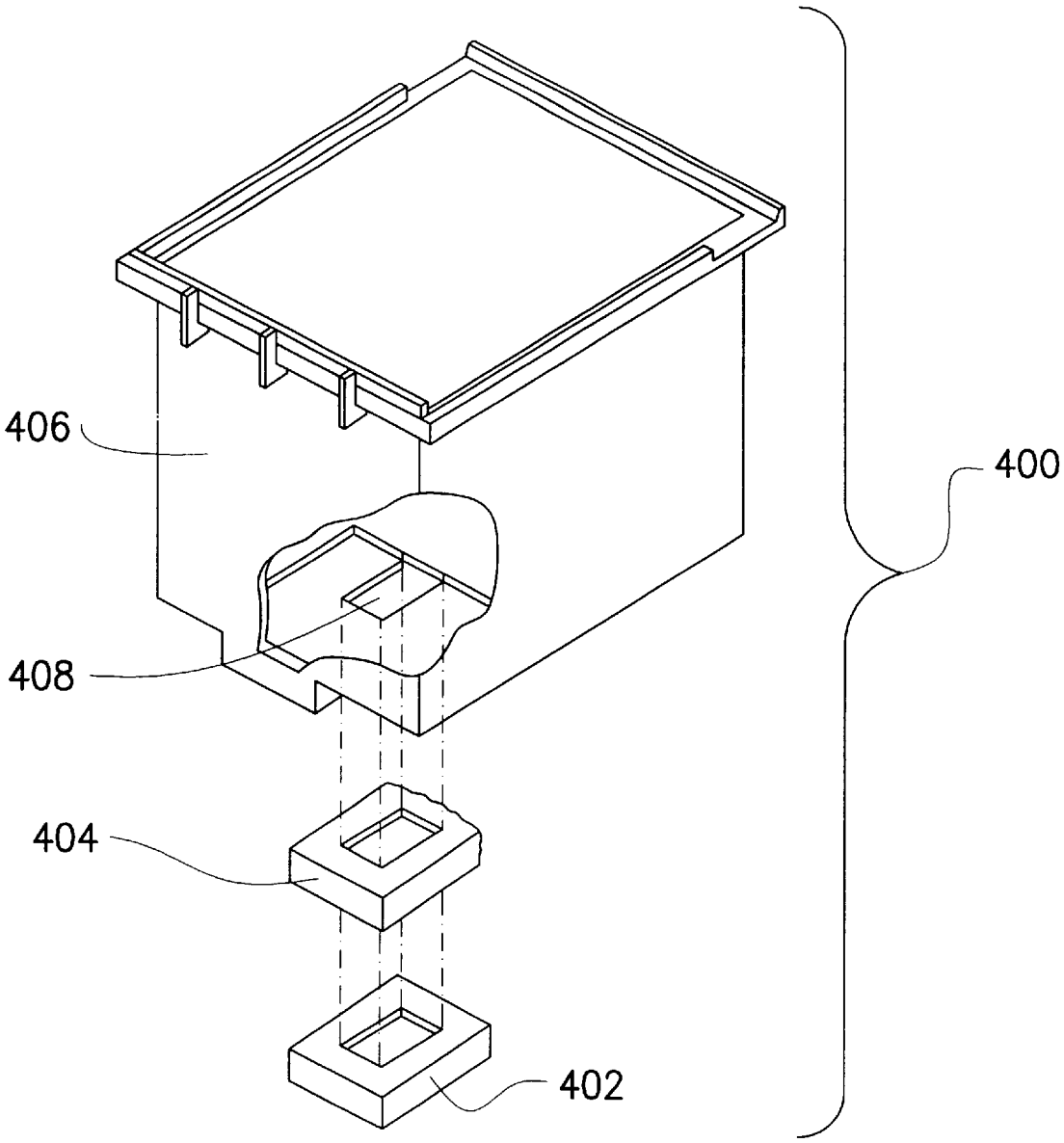
FIG. 18 is a schematic view showing a process for producing a piezoelectric inkjet printhead according to a seventh preferred embodiment of the present invention.

FIG. 18 is a schematic exploded view of a piezoelectric inkjet printhead according to a seventh preferred embodiment of the present invention. The ink cartridge 400 has an ink storage module 406 with an opening 408, an ink channel 404 and a piezoelectric jet module 402 in sequence.

The ink storage module 406 is used to store the ink in the ink cartridge. Therefore, the ink storage module 406 is a hollow cartridge defined by lids and cartridge walls. The opening 408 in the bottom of the ink storage module 406 enables the ink in the ink storage module 406 to flow into the piezoelectric jet module 402 through the ink channel 404.

Furthermore, in order to prevent the ink in the ink cartridge from leaking when not printing, a leak proof device can be further provided in the ink storage module 406 to balance the pressure therein. The leak proof device can be made of, but is not limited to, microporous material or resilient elastomer so as to provide capillary attraction or an elastic force for leakage prevention. Examples of the microporous material include plastics and foamed rubbers. The resilient elastomer can include spring elements. Furthermore, in order to prevent the ink from contacting with the outside air and from generating micro bubbles therein, an ink bag can also be provided in the ink storage region of the storage module 406 to store the ink. In the case that the ink storage region of the ink storage module 406 is isolated from the air outside, an air bag can be further provided for balancing the pressure in the module 406. Alternatively, both the ink bag and the air bag can be used together in the ink storage module 406.

The ink channel 404 is located between the ink storage module 406 and the piezoelectric jet module 402. The ink channel 404 has a passage through the ink channel 406. One end of the passage communicates with the opening 408 in the bottom of the ink storage module 406 and the other end of the passage communicates with an opening at the top of the piezoelectric jet module 402, such that the ink can flow from the module 406 to the module 402. If the ink channel 404 is made of microporous material, a function of temporary ink storage can be further provided.

The piezoelectric jet module 402 is located beneath the ink channel 404. The piezoelectric jet module 402 consists of piezoelectric connection circuits and an inkjet printhead with a plurality of ink chambers therein. At least one opening is provided on the top of the piezoelectric jet module 402 to enable the ink to flow from the ink channel 404 into the ink chamber of the inkjet printhead. The piezoelectric connection circuit of the piezoelectric jet module 402 includes upper and lower electrodes connected to ends of the piezoelectric layer and a control circuit connected to the electrodes and edges of the ink cartridge. When a printer sends a signal for printing out, the control circuit transmits the signal to a designated electrode to carry out the printing operation.

Other elements of the piezoelectric jet module 402 of this example are similar to those described in the above Embodiments 1–6. Therefore, their descriptions are omitted.

The piezoelectric jet module of the present invention includes a substrate, a bottom film, chamber walls, an ink chamber, an upper-wall protection layer, a lower electrode, piezoelectric layer and an upper electrode. The ink chamber is a hollow region that is defined by the bottom film, the chamber walls and the upper-wall protection layer, respectively. The bottom film having an ink inlet and an ink outlet forms the bottom of the ink chamber. The chamber walls form sidewalls of the ink chamber. The upper-wall protection layer is located at the top of the ink chamber. The material used to form the upper-wall protection layer includes ceramics. The upper-wall protection layer can be optionally removed.

In this example, one ink chamber and single ink outlet are described for ease of illustration. However, for some applications, a plurality of small chambers connected to each other can be used instead of a big chamber to receive a single ink outlet.

In light of the foregoing, after the piezoelectric layer is formed, the chamber walls and the bottom film can be obtained by exposure/development using the photosensitive polymer to integrally form an inkjet printhead. The cycle time can be significantly reduced and the cost and labor of production can thus be reduced, while the yield is increased.

It will be apparent to those skilled in the art that various modifications and variations can be made to the structure of the present invention without departing from the scope or spirit of the invention. In view of the forgoing, it is intended that the present invention cover modifications and variations of this invention provided they fall within the scope of the following claims and their equivalents.

What is claimed is:

1. A process for producing a piezoelectric inkjet printhead, comprising:

forming a plurality of lower electrodes on a substrate;

forming a piezoelectric layer on the substrate and the lower electrodes;

forming a plurality of upper electrodes on the piezoelectric layer;

forming a first photosensitive polymer layer on the upper electrodes and the piezoelectric layer;

removing a portion of the first photosensitive polymer layer to form a plurality of chamber walls that define a plurality of ink chambers, wherein each of the ink chambers has at least a lower electrode and an upper electrode;

forming a second photosensitive polymer layer on top of the chamber walls; and removing a portion of the second photosensitive layer to form a top film having a plurality of ink inlets and a plurality of ink outlets, wherein each of the ink chambers has an ink inlet and an ink outlet.

2. The process of claim 1, wherein the lower electrodes are made of copper, gold, silver, platinum, palladium, or alloys thereof.

3. The process of claim 1, wherein the lower electrodes are formed by:

forming a metal layer in the substrate; and removing a portion of the metal layer.

4. The process of claim 3, wherein the metal layer is formed by sputtering, evaporation, chemical deposition, electrical plating or electroless plating.

5. The process of claim 1, wherein the piezoelectric layer is formed by spin coating, and wherein the piezoelectric layer is made of poly(vinylidene fluoride) or lead zirconate titanate.

6. The process of claim 1, wherein the ink chamber, the ink inlet and the ink outlet are formed by photolithography.

7. The process of claim 1, wherein the first photosensitive polymer layer and the second photosensitive polymer layer include a dry film photoresist, a liquid type photoresist, a positive type photoresist, a negative type photoresist, a photosensitive polyimide and photosensitive epoxy.

8. A process for producing a piezoelectric inkjet printhead, comprising:

forming a through hole in a substrate;

forming a first photosensitive polymer layer on the substrate;

removing a portion of the first photosensitive polymer layer to form a bottom film having a plurality of ink inlets and a plurality of ink outlets;

forming a second photosensitive polymer layer on the bottom film;

removing a portion of the second photosensitive polymer layer to form a plurality of chamber walls that defines a plurality of ink chambers, wherein each of the ink chambers has at least one ink inlets and one ink outlet; and forming a ceramic layer on the chamber walls, wherein the ceramic layer has a plurality of upper electrodes, a piezoelectric layer and a plurality of lower electrodes and wherein each of the ink chambers has at least one upper electrode and one lower electrode.

9. The process of claim 8, wherein the ink chamber, the ink inlet and the ink outlet are formed by photolithography.

10. The process of claim 8, wherein the first photosensitive polymer layer and the second photosensitive polymer layer include a dry film photoresist, a liquid type photoresist, a positive type photoresist, a negative type photoresist, a photosensitive polyimide and photosensitive epoxy.

11. The process of claim 8, wherein the upper electrode and the lower electrode are made of copper, gold, silver, platinum, palladium, or alloys thereof.

12. The process of claim 8, wherein the piezoelectric layer is made of poly(vinylidene fluoride) or lead zirconate titanate.

13. The process of claim 8, further comprising removing the substrate after forming the ceramic layer on the chamber walls.

14. A process for producing a piezoelectric inkjet printhead, comprising:

forming a through hole in a substrate;

forming a first photosensitive polymer layer on the substrate;

removing a portion of the first photosensitive polymer layer to form a bottom film having a plurality of ink outlets;

forming a second photosensitive polymer layer on the bottom film;

removing a portion of the second photosensitive polymer layer to form a plurality of chamber walls that define a plurality of ink chambers, wherein each of the ink chambers has at least one ink outlet;

forming a ceramic layer on the chamber walls;

forming a plurality of ink inlets in the ceramic layer, wherein the ink inlet is located opposite the ink outlet;

forming a plurality of lower electrodes on the ceramic layer, so that each of the lower electrodes is provided for one of the ink chambers;

forming a piezoelectric layer on the lower electrodes; and forming a plurality of electrodes on the piezoelectric layer.

15. The process of claim 14, wherein the ink chamber and the ink outlet are formed by photolithography.

16. The process of claim 14, wherein the first photosensitive polymer layer and the second photosensitive polymer layer include a dry film photoresist, a liquid type photoresist, a positive type photoresist, a negative type photoresist, a photosensitive polyimide and photosensitive epoxy.

17. The process of claim 14, wherein the ink inlet is formed by mechanical drilling or particle bombing.

18. The process of claim 14, wherein the upper electrode and the lower electrode are made of a material selected from copper, gold, silver, platinum, palladium, or alloys thereof.

19. The process of claim 14, wherein the piezoelectric layer is made of poly(vinylidene fluoride) or lead zirconate titanate.

20. The process of claim 14, further comprising removing the substrate after forming the ceramic layer on the chamber walls.

* * * * *